US006717137B2

(12) United States Patent
Hofstadler et al.

(10) Patent No.: US 6,717,137 B2
(45) Date of Patent: Apr. 6, 2004

(54) SYSTEMS AND METHODS FOR INDUCING INFRARED MULTIPHOTON DISSOCIATION WITH A HOLLOW FIBER WAVEGUIDE

(75) Inventors: Steven A. Hofstadler, Oceanside, CA (US); Jared J. Drader, Encinitas, CA (US)

(73) Assignee: Isis Pharmaceuticals, Inc., Carlsbad, CA (US)

( * ) Notice: Subject to any disclaimer, the term of this patent is extended or adjusted under 35 U.S.C. 154(b) by 0 days.

(21) Appl. No.: 10/167,269

(22) Filed: Jun. 11, 2002

(65) Prior Publication Data

US 2003/0016926 A1 Jan. 23, 2003

Related U.S. Application Data

(60) Provisional application No. 60/297,351, filed on Jun. 11, 2001.

(51) Int. Cl.[7] ..... H01J 49/04

(52) U.S. Cl. ..... 250/288; 250/290; 250/291; 250/292

(58) Field of Search ..... 250/288, 290, 250/291, 292

(56) References Cited

U.S. PATENT DOCUMENTS 4,686,367 A * 8/1987 Louris et al. ..... 250/290
5,118,937 A 6/1992 Hillenkamp et al. ..... 250/282
5,440,664 A 8/1995 Harrington et al. ..... 385/125
6,140,656 A 10/2000 Fujii ..... 250/492.21

OTHER PUBLICATIONS

Little et al., "Infrared Multiphoton Dissociation of Large Multiply Charged Ions for Biomolecule Sequencing," Analytical Chemistry, vol. 66, No. 18, Sep. 15, 1994, pp 2809–2815.

* cited by examiner

*Primary Examiner*—Jack Berman
(74) *Attorney, Agent, or Firm*—Hale and Dorr LLP

(57) ABSTRACT

The present disclosure is related to improved systems and methods for inducing infrared multiphoton dissociation (IRMPD) of an ion. In an exemplary embodiment, the system includes
an ion dissociation chamber and an infrared waveguide coupled to the ion dissociation chamber. The infrared waveguide may be positioned to receive infrared energy from an infrared energy source and direct the infrared energy towards ions in the ion dissociation chamber for the purpose of fragmenting the ions. The infrared waveguide can be made of a hollow fused silica body with an inner infrared reflective layer. The infrared waveguide may be flexible. A system may further include a focusing lens, an infrared transparent window and an aperture housing that has an orifice. The ion dissociation chamber may be an ion trap, an ion guide or an ion reservoir.
In one embodiment, ions may be directed into an ion storage area of an ion dissociation chamber, the infrared energy is directed into the infrared waveguide which is aligned with the ion storage area and then infrared energy is delivering to the ions located within the ion storage area.

37 Claims, 4 Drawing Sheets

SYSTEMS AND METHODS FOR INDUCING INFRARED MULTIPHOTON DISSOCIATION WITH A HOLLOW FIBER WAVEGUIDE

REFERENCE TO RELATED U.S. APPLICATIONS

This application claims priority to U.S. Provisional Patent Application No. 60/297,351 filed Jun. 11, 2001, the entire contents of which are herein incorporated by reference.

BACKGROUND OF THE INVENTION

The present invention relates to systems and methods for inducing infrared multiphoton dissociation of ions for mass spectrometry analysis. More specifically, the present invention relates to systems and methods for inducing infrared multiphoton dissociation of ions for mass spectrometry analysis by delivering infrared energy to an ion dissociation chamber via an infrared waveguide.

Infrared multiphoton dissociation (IRMPD) is increasingly being used to induce fragmentation of molecular ions to provide sequence/structural information for mass spectrometric characterization of biomolecules. See Stephenson et al., "Analysis of Biomolecules Using Electrospray Ionization-Ion Trap Mass Spectrometry and Laser Photodissociation," ASC Symp. Ser. 619:512–564 (1996), the entire contents of which are herein incorporated by reference. Unfortunately, finding materials that are suitable for the transmission of infrared energy has proven to be difficult. Today most infrared optical components are generally made of a Barium-fluoride (BaF) or a Zinc-Selenium (ZnSe) compositions that have special infrared-compatible coatings.

SUMMARY OF THE INVENTION

The present disclosure is directed at improved systems and methods for inducing infrared multiphoton dissociation of ions for mass spectrometry analysis. In an exemplary embodiment in accordance with present disclosure, the system has an ion dissociation chamber that has an ion storage area and an infrared waveguide that is coupled to the ion dissociation chamber. The infrared waveguide can be positioned to receive infrared energy (e.g., an infrared laser beam) generated by an infrared energy source and direct the infrared energy towards ions located in the ion dissociation chamber for the purpose of fragmenting the ions. The system may also include a focusing lens located between the infrared laser energy source and an end of the infrared waveguide. In certain exemplary embodiments, the infrared waveguide is a hollow fiber waveguides (HFWG). Some HFWGs have been shown to transmit high power infrared energy at 10.6 $\mu$m in excess of 1000 Watts with minimal power loss which can make them suitable since IRMPD typically only employs about 2–20 Watts. In a preferred embodiment, the infrared waveguide can be comprised of a hollow fused silica body that has an optically reflective inner layer. The infrared waveguide preferably is flexible.

In other exemplary embodiments, the system may also include an aperture housing having an orifice located between an infrared laser energy source and an end of the infrared waveguide. The aperture housing may protect the end of the infrared waveguide from the harmful effects of the infrared energy. In some embodiments, the inner diameter of the orifice may be less than or equal to the hollow inner diameter of the infrared waveguide.

In yet other exemplary embodiments in accordance with the present disclosure, the system may also include a positional alignment system coupled an end of the infrared waveguide. The positional alignment system can control the location of the end of the infrared waveguide relative to an infrared energy beam.

In another exemplary embodiment, a system may further include an infrared transparent window coupled to an end of the infrared waveguide. The infrared transparent window may assist in maintaining a desired pressure within the ion dissociation chamber.

In certain exemplary embodiments in accordance with the present disclosure, an end of the infrared waveguide is aligned substantially orthogonally to a longitudinal axis of the ion storage area of the ion dissociation chamber. In other embodiments, an end of the infrared waveguide is aligned substantially parallel to the longitudinal axis of the ion storage area. While in yet other embodiments, an end of the infrared waveguide is aligned substantially non-orthogonally to the longitudinal axis of the ion storage area.

In other exemplary embodiments, the ion dissociation chamber can further include infrared reflective element to reflecting the infrared energy delivered by the infrared waveguide back towards the ion storage area.

In certain exemplary embodiments in accordance wit the present disclosure, the ion dissociation chamber can be an ion trap, an ion reservoir or an ion guide, such as a linear multi-pole ion trap or a cylindrical multi-pole ion trap.

Still other objects and advantages of the present invention will become readily apparent to those skilled in the art from the following detailed description wherein several embodiments are shown and described. As will be realized, the invention is capable of other and different embodiments, and its several details are capable of modifications in various respects, all without departing from the invention. Accordingly, the drawings and description are to be regarded as illustrative in nature, and not in a restrictive or limiting sense, with the scope of the application being indicated in the claims.

BRIEF DESCRIPTION OF THE FIGURES

For a fuller understanding of the nature and objects of the present invention, reference should be made to the following detailed description taken in connection with the accompanying drawings in which the same reference numerals are used to indicate the same or similar parts wherein.

DETAILED DESCRIPTION OF THE PREFERRED EMBODIMENTS

The present disclosure is directed to systems and methods for inducing infrared multiphoton dissociation (IRMPD) of ions. The dissociated, or fragmented, ions may then be subjected to mass spectrometric (MS) detection and analysis. A hollow fiber waveguide (HFWG) can be used to transmit an infrared laser beam into a ion dissociation chamber, where irradiation and dissociation of the ions may occur.

Infrared multiphoton dissociation (IRMPD) is increasingly used to induce fragmentation of molecular ions to provide sequence/structural information for mass spectrometric characterization of biomolecules. Because IRMPD is a broadband activation technique, multiple charge state ions (or multiple species) can be dissociated simultaneously. Some molecules which are refractory (e.g., resistant) to dissociation by collisional activation may be dissociated via IRMPD. The HFWG approach to IRMPD, as provided in the present disclosure, additionally may provide a way in which IRMPD capabilities can be added to any ion reservoir or ion trap mass spectrometer in a straightforward retrofit-able manner.

Figure 1:
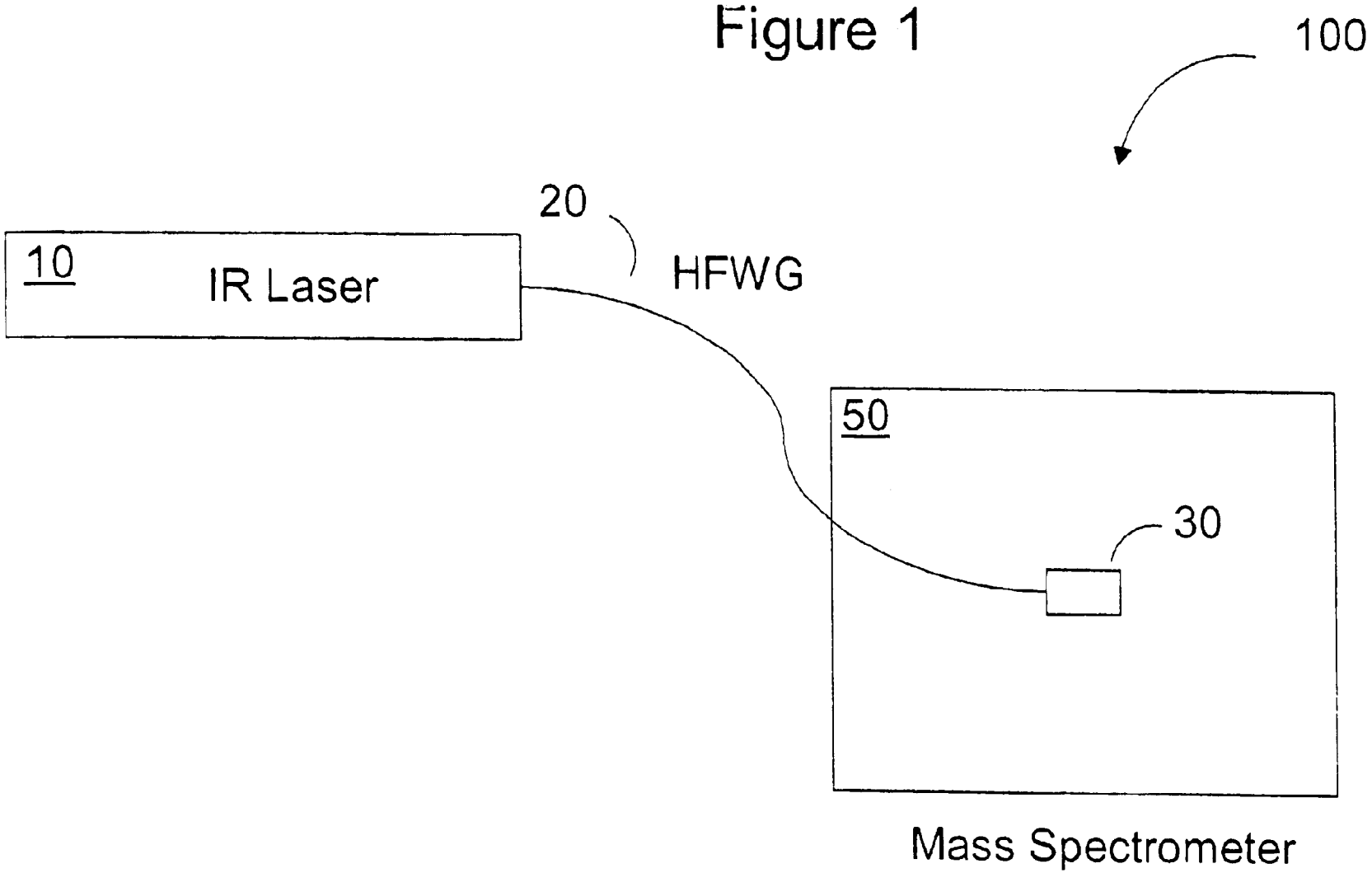
FIG. 1 depicts an exemplary embodiment of a system in accordance with the present disclosure.

FIG. 1 illustrates an exemplary system 100 in accordance with the present disclosure. The system 100 of FIG. 1 includes an infrared laser source 10 and an infrared waveguide 20 coupled to a ion dissociation chamber 30. The infrared laser source 10 may be a continuous wave (CW) or a pulsed laser source. In an exemplary embodiment, the infrared laser source 10 can be a 25 Watt CW $CO_2$ laser, such as the model 48-2 laser unit available from Synrad, Inc. of Mukilteo, Wash., which operates at a wavelength in the range of approximately 10.57–10.63 $\mu$m. Persons skilled in the art, however, will recognize a wide variety of other infrared laser sources that may be used without departing from the scope of the present disclosure. In an exemplary embodiment, the ion dissociation chamber 30 comprises one stage of a mass spectrometry system 50, as illustrated in FIG. 1. In a preferred embodiment, the ion dissociation chamber 30 is an ion trap of an a mass spectrometry system 50 or an ion reservoir, which may be external to a mass spectrometry system 50.

In accordance with the present disclosure, the infrared waveguide 20 may be a hollow fiber waveguide (HFWG). In a preferred embodiment, the infrared waveguide is comprised of a fused silica hollow (e.g., capillary) tube which has an optically reflective internal coating or layer. The internal coating may be comprised of silver halide. For protection, the infrared waveguide 20 may be coated with an external jacket comprised of acrylate, for example. The external jacket may also provide stabilization and strain-relief of the infrared waveguide 20, which, in combination with the fused silica tube, may allow the infrared waveguide 20 to be flexible. Thus, in a preferred embodiment, some bending of the infrared waveguide 20 can occur before any substantial structural degradations or surface imperfections will arise. In a preferred embodiment, the infrared waveguide 20 has an inner hollow diameter of approximately 1 mm or less. Exemplary embodiments of an infrared waveguide 20, as described herein, are available, for example, from Polymicro Technologies, LLC of Phoenix, Ariz.

In an exemplary embodiment, the mass spectrometry system 50 is an Apex II 70e electrospray ionization Fourier transform ion cyclotron resonance (FTICR) mass spectrometer with an actively shielded seven telsa superconducting magnet, available from Bruker Daltonics, Inc. of Billerica, Mass. However, persons skilled in the art will readily recognize a wide variety of mass spectrometry systems that may be used without departing from the scope of the present disclosure.

Figure 2:
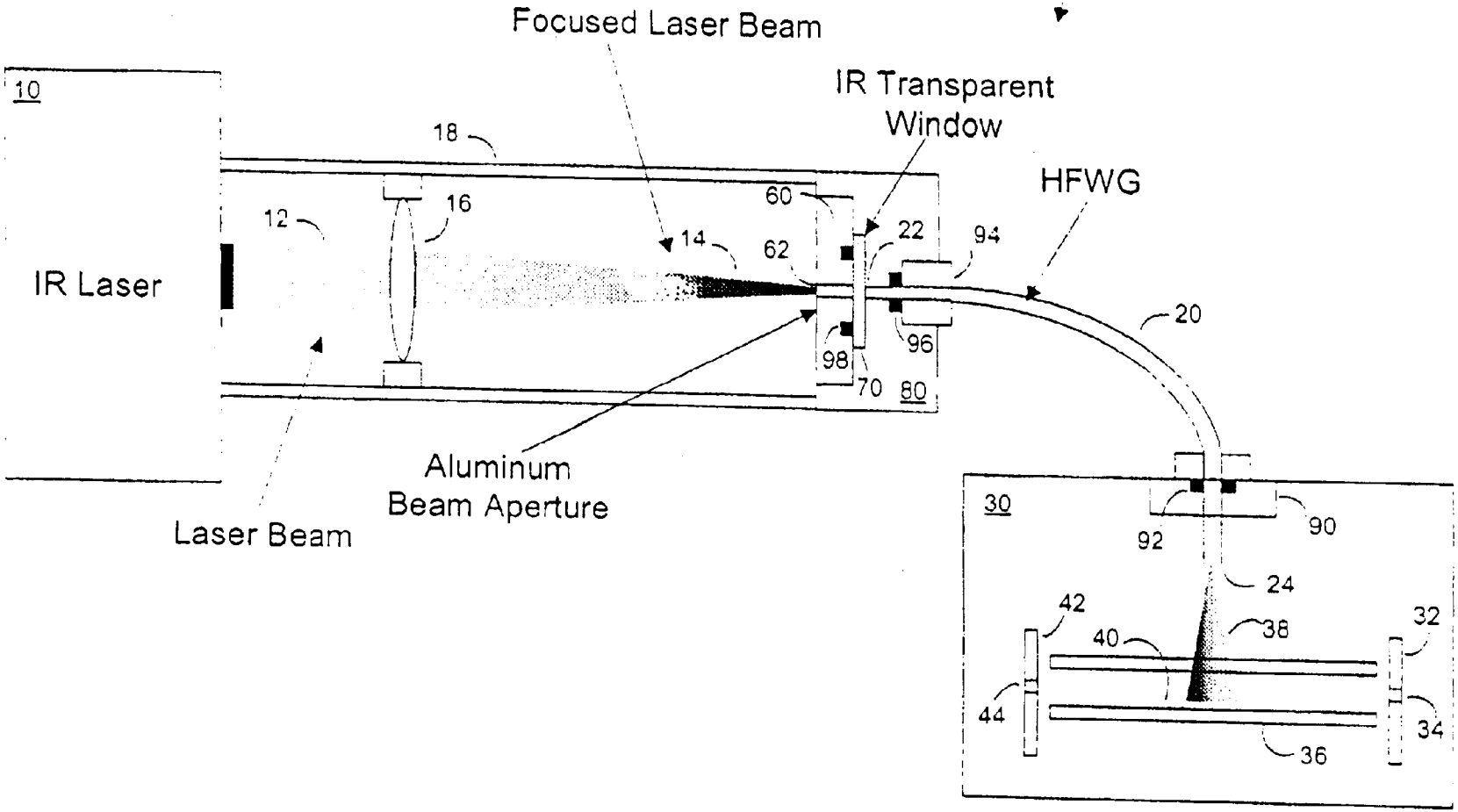
FIG. 2 depicts another exemplary embodiment of a system in accordance with the present disclosure.

FIG. 2 illustrates an exemplary system 200 in accordance with the present disclosure. System 200 includes an infrared laser source 10, a laser interface 18 coupled to the infrared laser source 10, a focusing lens 16 located within the laser interface 18 and an aperture housing 60 which is located at one end of the laser interface 18. The operation of the infrared laser 10 may be controlled by a controller (not shown) which may send commands to the infrared laser 10. In some embodiments, these commands could be delivered via a TTL pulse. The laser interface 18 houses the infrared laser beam 12, which is emitted from the infrared laser 10. As shown in FIG. 2, the emitted laser beam 12 may be directed through a focusing lens 16 to obtain a focused infrared laser beam 14. The focusing lens 16 generally should be transparent (or nearly transparent) at the infrared wavelength of the laser beam 12 generated by the infrared laser source 10. In an exemplary embodiment, the focusing lens 16 can be comprised of Zinc-Selenium having an anti-reflective outer coating. In some exemplary embodiments, the focusing lens 16 may be a 5" focal length plano-convex lens, such as those which are available from II-VI Incorporated of Saxonburg, Pa.

The aperture housing 60 has an orifice 62 that, in a preferred embodiment, is aligned with the inner diameter (not shown) of the infrared waveguide 20. The aperture housing 60 can protect the entrance end (i.e., proximal end 22) of the infrared waveguide 20 from being damaged by the high-energy focused infrared laser beam 14 when the beam 14 is misaligned or not properly focused. Specifically, the aperture housing 60 can protect the sensitive layers (the materials and/or coatings) of the infrared waveguide 20 from the harmful effects of portions of the focused infrared laser beam 14 (or the infrared laser beam 12, if no focusing lens is used), or the portions thereof, that might otherwise strike (i.e., not enter) a proximal end 22 of the infrared waveguide 20. Thus, the aperture housing 60 can act as a spatial filter to allow only those portions of the focused infrared laser beam 14 that enters the orifice 62 of the aperture housing 60 to pass through to the infrared waveguide 20. The portion of the focused infrared laser beam 14 that strikes outside of the orifice 62 is prevented from proceeding further in the system 200. The aperture housing 60 can be made of a material(s) that is suitable for blocking an infrared laser beam, such as an aluminum alloy, for example.

Amongst other factors, the power density of the portion of the focused infrared laser beam 14 that enters the infrared waveguide 20 can be controlled, to some extent, by adjusting the distance from the focusing lens 16 to the aperture housing 60, controlling the width of the infrared beam 12, adjusting the wavelength of the infrared laser beam 12, altering the focal length of the focusing lens 16, adjusting the position of the aperture housing 60 and/or by changing the diameter of the orifice 62. To ensure adequate protection of the proximal end 62 of the infrared waveguide 20, however, in a preferred embodiment the inner diameter of the orifice 62 is equal to, or less than, the inner diameter of the infrared waveguide 20. In system 200, for example, the inner diameter of the orifice may be 200 microns while the inner diameter of the infrared waveguide 20 may be 1000 microns.

System 200 of FIG. 2 further includes an infrared transparent window 70 mated to the proximal end 22 of the infrared waveguide 20 and the aperture housing 60. The presence of an infrared transparent window 70 at one of the ends of the infrared waveguide 20 can assist in maintaining a low pressure within the ion dissociation chamber 30. In accordance with the present disclosure, the hollow interior of the infrared waveguide 20 may be maintained at atmospheric pressure or at a low pressure that may be suitable for the operation of the ion dissociation chamber 30. It is important that the systems and methods described herein do not compromise the integrity of the pressure that needs to be maintained within the ion dissociation chamber 30. A fluid-tight seal may exist between the infrared transparent window 70 and an end of the infrared waveguide 20. In system 200, a fluid-tight seal exists between the infrared transparent window 70 and the proximal end 22 of the infrared waveguide 20, thus, creating a pressure barrier between the pressure maintained within the laser interface 18 and orifice 62, which may be atmospheric pressure, and the pressure maintained within the ion dissociation chamber 30, which may be a relatively low pressure.

In some embodiments, a seal (not shown), such as an o-ring for example, may also be present at the proximal end 22 of the infrared waveguide 20. Thus, the use of an infrared transparent window 70 at one (or both) of the ends of the infrared waveguide 20 may prevent dissipation of the pressure maintained within the ion dissociation chamber 30. As shown in FIG. 2, a seal 98 may also be used to create a fluid-tight seal between the aperture housing 60 and the infrared transparent window 70. Seal 98, therefore, creates a pressure barrier between the pressure of the laser interface 18 and orifice 62 (e.g., atmospheric) and the pressure of the ion dissociation chamber 30 (e.g., low pressure). Seal 98 can typically be a resilient o-ring, as shown in FIG. 2.

In the exemplary embodiment illustrated in FIG. 2, the focused infrared laser beam 14 passes through the aperture housing 60 via orifice 62 and through the infrared transparent window 70 prior to entering the infrared waveguide 20. Accordingly, to reduce or minimize beam energy losses, the infrared transparent window 70 should be comprised of materials that are transparent (or nearly transparent) at infrared wavelengths. In an exemplary embodiment, the infrared transparent window 70 is comprised of a Barium-fluoride composition, such as those which are available from Bicron (e.g., 2 mm×13 mm BaF2 lens part #0865018 01302 BaF2), for example. In an alternative embodiment, as stated, an infrared transparent window 70 may be coupled to a proximal end 24 of the infrared waveguide 20.

The system 200 of FIG. 2 also further includes a positional alignment system 80 that controls the physical location, in two or three dimensions, of the proximal end 22 of the infrared waveguide 20. In one embodiment, the positional alignment system 80 can control the x- and y-axes locations (wherein the z axis corresponds to direction in which the laser beam 12, 14 travels from the infrared laser source 10 to the proximal end 22 of the infrared waveguide 20) of the proximal end 22 of the infrared waveguide 20. In those embodiments which utilize an aperture housing 60 and/or an infrared transparent window 70 coupled to the proximal end 22 of the infrared waveguide 20, as shown in FIG. 2, the positional alignment system 80 can further control the locations of these components since they may be coupled (either directly or indirectly) to the proximal end 22 of the infrared waveguide 20. The position the proximal end 22 of the infrared waveguide (or the orifice 62 of the aperture housing 60, if present) may be adjusted based upon a measurement or detection of a delivered infrared laser beam 38 (or a portion thereof) within the ion dissociation chamber 30. For example, the presence of the delivered infrared laser beam 38 within the ion dissociation chamber 30 can be detected by utilizing thermo-sensitive paper. Based upon these measurements or detections, the location of the proximal end 22 of the infrared waveguide (or the aperture housing 60/infrared transparent window 70/proximal end 22 combination) can be adjusted via the positional alignment system 80 to obtain a delivered infrared laser beam 38 having a desired power density. In another embodiment, the positional alignment system 80 can also control the z-axis location of the proximal end 22 of the infrared waveguide 20. The positional alignment system 80 can be a controllable two (or three)-axis actuator system. Persons skilled in the art, however, will readily recognize a wide variety of other positional alignment systems 80 that may be used in accordance with the present disclosure.

An exemplary system may further include a feedthrough 94 to help prevent the low pressure that may be maintained within the ion dissociation chamber 30 from being compromised due to the presence of the infrared waveguide 20. In an exemplary embodiment, the feedthrough 94 may be a pierceable septum-style feedthrough that is comprised of a resilient material. To further ensure the integrity of the ion dissociation chamber 30, a seal 96 may also be used with the feedthrough 94. Seal 96, in conjunction with feedthrough 94, can create a fluid-tight seal between the proximal end 22 of the infrared waveguide 20 and the feedthrough 94. Seal 96 and feedthrough 94, thus, create a pressure barrier between the pressure that is external to the system 200 (e.g., atmospheric) and the pressure of the ion dissociation chamber 30 (e.g., low pressure). The seal 96 can typically be a resilient o-ring, as shown in FIG. 2.

The system 200 of FIG. 2 additionally includes a feedthrough 90, which can also prevent the pressure within the ion dissociation chamber 30 from being compromised. In an exemplary embodiment, the feedthrough 90 may be a pierceable septum-style feedthrough that is comprised of a resilient material. To further ensure the integrity of the ion dissociation chamber 30, a seal 92 may also be present. Seal 92 and feedthrough 90 can create a pressure barrier between the pressure of the ion dissociation chamber 30 and the pressures that are external to the system 200. The seal 92 can be a resilient o-ring, as shown in FIG. 2.

The ion dissociation chamber 30 will generally have electrical components that are capable of generating an electrical field within the ion dissociation chamber 30. RF and/or DC electrical currents may be applied to the electrical components by the mass spectrometry system 50, for example, to generate a desired electric field within the ion dissociation chamber 30. The electric field that is generated in the ion dissociation chamber 30 will determine an ion storage area 40. The ion storage area 40 represents a location (i.e., volume) within the ion dissociation chamber 30 where ions having stable trajectories may be found. The ion dissociation chamber 30, depicted in FIG. 2, for example, could be representative of an ion trap having electrical rods 36 (e.g., quadrupole or hexapole) and electrical end caps 32 and 42. In such an embodiment, electrical end caps 32 and 42 may have an entrance 34 and exit 44, respectively, for permitting the controlled gated entry (via entrance 34) and exiting (via exit 44) of the ions (including fragmented, or daughter, ions) within the ion dissociation chamber 30. In an alternate embodiment, the electrical components may be arranged to form a gated ion tunnel which uses ring elements. Thus, in accordance with then present disclosure, the ion dissociation chamber 30 can be a linear multi-pole trap, such as a linear quadrupole ion trap or a linear hexapole ion trap, for example, a cylindrical multi-pole ion trap, such as cylindrical quadrupole ion trap (e.g., a Paul trap), a linear or cylindrical multi-pole ion guide or a linear or cylindrical ion reservoir. In addition to these, however, persons skilled in the art will recognize a wide variety of other ion dissociation chambers 30 that may be used without departing from the scope of the present disclosure.

In infrared multiphoton dissociation (IRMPD), ions (e.g., ionized compounds) are subjected to an infrared (e.g., coherent) energy to cause the ionized ions to fragment into their constituent parts. In IRMPD, the effectiveness of the fragmentation process can depend upon the chemical properties of the ions to be fragmented, the power density of the delivered infrared energy beam 38 and the amount of the ion storage area 40 that is exposed to the delivered infrared energy beam 38. To deliver infrared energy to the ion storage area 40 and, thus, promote the dissociation of ions, the distal end 24 of the infrared waveguide 20 is aligned with at least a portion of the ion storage area 40 of the ion dissociation chamber 30. By aligning the distal end 24 of the infrared waveguide 20 with the ion storage area 40, ions traveling within the storage area 40 may be exposed to at least a portion of the delivered infrared laser beam 38. The power density of the delivered infrared energy beam 38 can be dependent upon the power output of the infrared power source 10, the losses which occur through the system 200, the focal length of the focusing lens 16 and the path characteristics of the infrared waveguide 20. The focal length of the focusing lens 16 and the path characteristics of the infrared waveguide 20 can both affect how much the delivered infrared laser beam 38 will disperse upon exiting the distal end 24 of the infrared waveguide 20. A more dispersed delivered infrared laser beam 38 will generally have a lower power density than a delivered infrared laser beam 38 which is less dispersed. A shorter focal length (of the focusing lens 16) will generally result in a more dispersed delivered infrared laser beam 38. While a more curved infrared waveguide 20, due to the resultant differences in effective path lengths, will generally result in greater dispersion than a straighter infrared waveguide 20.

The effectiveness of the fragmentation process may also depend upon whether a gas is present within the ion dissociation chamber 30. The presence of a gas within the ion dissociation chamber 30 may be desired to promote collisional focusing (or damping) of the ions located in the ion dissociation chamber 30. By impacting gas present in the ion dissociation chamber 30, the ions may become more concentrated within the ion storage area 40 and, thus, be more easily subjected to an infrared energy beam. The use of a damping gas within an ion dissociation chamber 30 for IRMPD is more fully described in U.S. Pat. No. 6,342,393, the entire contents of which are herein incorporated by reference.

In one embodiment in accordance with the present disclosure, the resultant power density of the delivered infrared laser beam 38 can be controlled (i.e., tuned) by adjusting or changing the focal length of the focusing lens 16. In another embodiment, the resultant power density of the delivered infrared laser beam 38 can be controlled by adjusting the location of the proximal end 22 of the infrared waveguide 20, relative to the location of the focused infrared laser beam 14. In yet another embodiment, the resultant power density of the delivered infrared laser beam 38 can be controlled by adjusting the path characteristics of the infrared waveguide 20, for example, by further bending or straightening the infrared waveguide 20.

In accordance with the present disclosure, the distal end 24 of the infrared waveguide 20 is located in proximity to, and aligned with, at least a portion of the ion storage area 40. In a preferred embodiment, the distal end 24 of the infrared waveguide 20 should not be directed at one of the electrical components, e.g., 32, 36 and 42. In other words, the main trajectory path 120 of the delivered infrared laser beam 38, from the distal end 24 to the ion storage area 40, should not, preferrably, be obstructed by one of the electrical components of the ion dissociation chamber 30. The ion storage area 40 of the ion dissociation chamber 30 has a longitudinal axis (not shown) that is defined by a path drawn from entrance 34 to exit 44. In the exemplary embodiment depicted in FIG. 2, the distal end 24 of the infrared waveguide 20 is aligned substantially orthogonally to and in proximity of the longitudinal axis of the ion storage area 40. In other exemplary embodiments, the distal end 24 of the infrared waveguide 20 may be oriented substantially parallel to the longitudinal axis of the ion storage area 30 and, in some embodiments, may be centered on (i.e., oriented on) the longitudinal axis. In yet other embodiments in accordance with the present disclosure, the distal end 24 of the infrared waveguide 20 may be oriented non-orthogonally to the longitudinal axis of the ion storage area 40.

Figure 3:
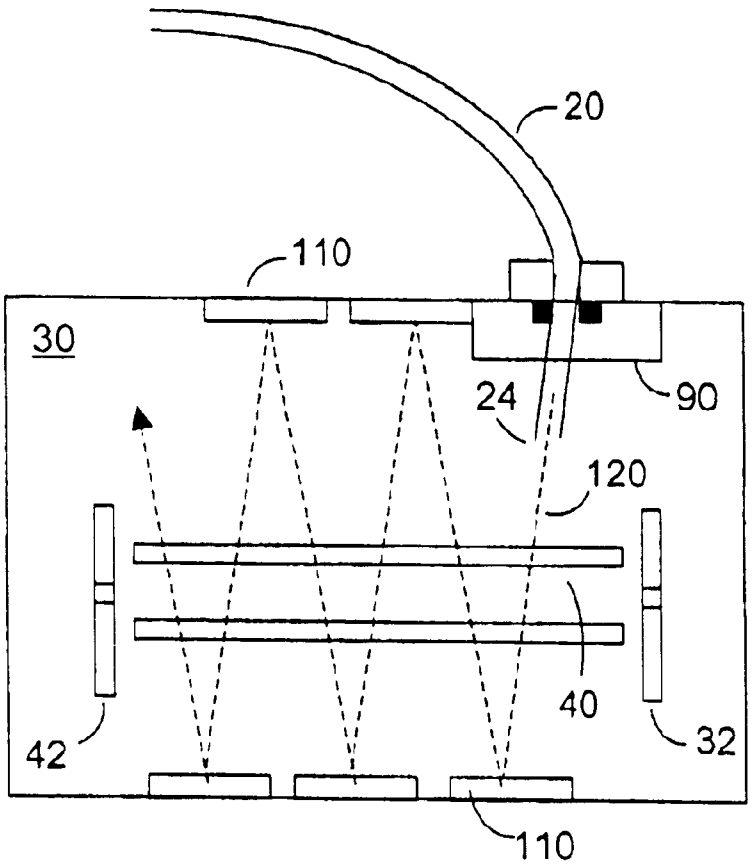
FIG. 3 depicts one exemplary embodiment of an infrared waveguide aligned within a ion dissociation chamber in accordance with the present disclosure.

To increase the amount of the ion storage area 40 that is exposed to the delivered infrared laser beam 38, reflective elements may be placed within the ion dissociation chamber 30. FIG. 3 illustrates an exemplary embodiment of an ion dissociation chamber 30 having infrared reflective elements 110. In FIG. 3, the distal end 24 of the infrared waveguide 20 is oriented non-orthogonally to the longitudinal axis of the ion storage area 40 so that the main trajectory path 120 of the delivered infrared laser beam 38 initially passes through the ion storage area 40 and then strikes an infrared reflective element 110. The delivered infrared laser beam 38 then reflects, along main trajectory path 120, from the infrared reflective element 110 back through the ion storage area 40, which may then strike another infrared reflective element 110, etc. To avoid damaging the distal end 24 of the infrared waveguide 20 and/or adversely affecting the power density of the delivered infrared laser beam 38 as it exist the waveguide 20, in a preferred embodiment, the distal end 24 of the infrared waveguide 20 and the infrared reflective elements 110 are arranged so that the main trajectory path 120 does not reflect back towards the distal end 24 of the infrared waveguide 20. In the exemplary embodiment depicted in FIG. 3, the distal end 24 of the infrared waveguide 20 is oriented towards an infrared reflective element 110 but arranged substantially non-orthogonally to the longitudinal axis of the ion storage area of the ion dissociation chamber In other exemplary embodiments, the ion dissociation chamber 30 may be comprised of a cylindrical body that has an inner infrared reflective wall.

In utilizing the systems and methods of the present disclosure, infrared energy transmission efficiencies of greater than 90% have been achieved via the infrared waveguide 20. For example, an infrared waveguide 20 has been inserted through a vacuum feedthrough, like feedthrough 90, which allowed direct (orthogonal) infrared irradiation of a hexapole ion reservoir, like ion dissociation chamber 30, of a Bruker 7T FTMS mass spectrometer instrument, like mass spectrometry system 50. With such an embodiment, one can effect extensive dissociation or oligonucleotides and peptides at modest laser source powers.

Figure 4:
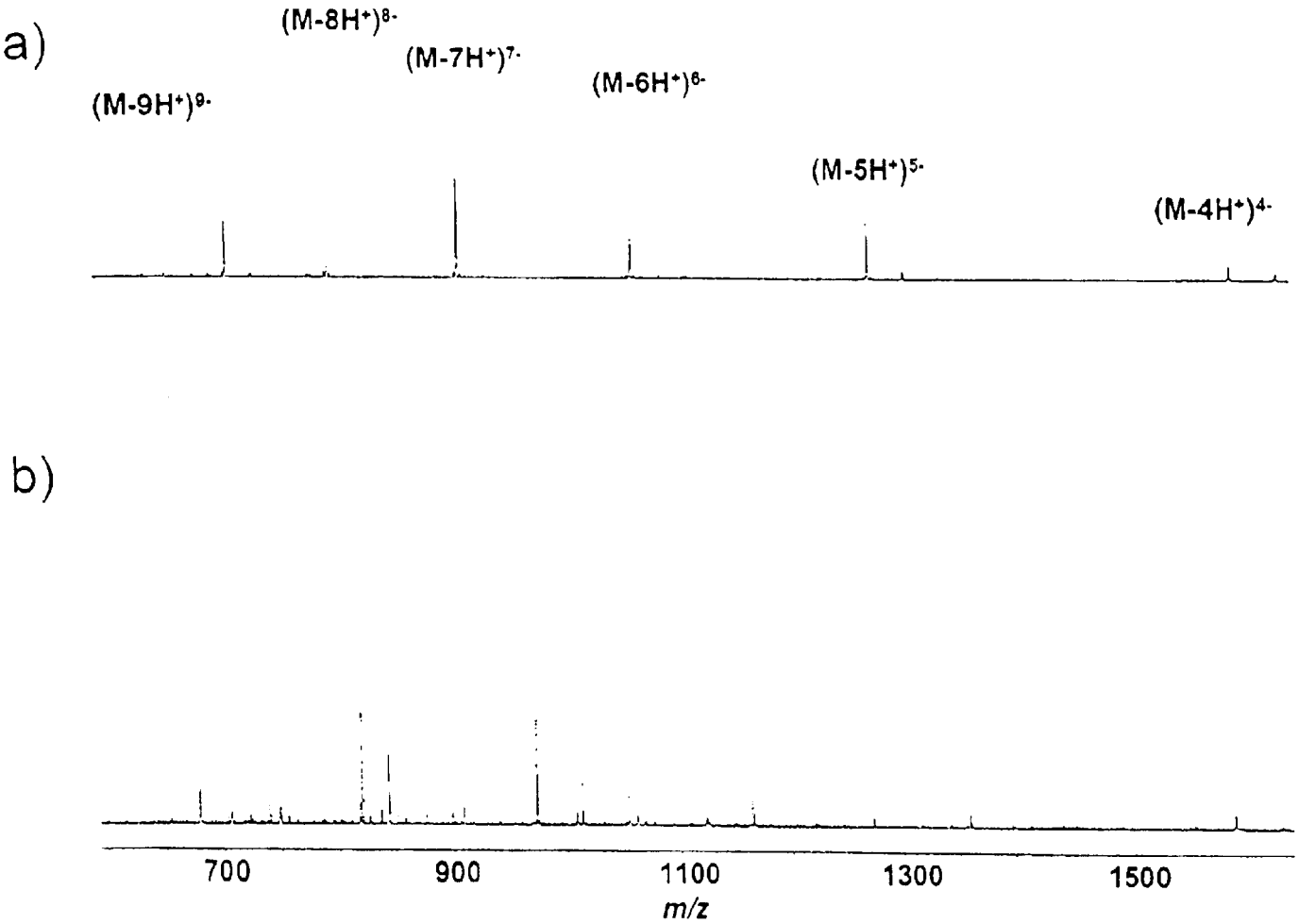
FIG. 4*a* illustrates a mass spectrum without infrared multiphoton dissociation.
FIG. 4*b* illustrates the mass spectrum of FIG. 4*a* after infrared multiphoton dissociation has occurred in accordance with the present disclosure.

FIG. 4*a* depicts a mass spectrum of gaseous ionized samples prior to be subjected to IRMPD in accordance with the present disclosure. FIGS. 4*a* and 4*b* map the relative abundance (on the vertical axis) of ions (or daughter ions) as a function of the ions mass-to-charge ratio, m/z, (on the horizontal axis). As can be seen in FIG. 4*a,* the mass spectrum of FIG. 4*a* includes some ions which have multiple electron charges, z. FIG. 4*b* depicts a mass spectrum of the same ionized samples of FIG. 4*a* after IRMPD has been induced in accordance with the present disclosure. As can be seen in these figures, the relative abundance of the higher mass/charge sampled depicted in FIG. 4*a* became lower (i.e., the mass/charge shifts to the left on the horizontal axis) after the induction of IRMPD, as seen in FIG. 4*b*. FIG. 4*b*, thus, is an indication of the effectiveness of the IRMPD process when conducted in accordance with the present disclosure since it reveal that many of the ionized samples (of FIG. 4*a*) have fragmented due to IRMPD.

Since numerous embodiments may be used to achieve the above systems and methods without departing from the scope of the present invention, it is intended that all matter contained in the above description or depicted in the accompanying drawings shall be interpreted as merely illustrative and not limiting the scope of the invention, which is set forth in the following claims.

What is claimed is:

1. A system for infrared multiphoton dissociation (IRMPD) of ions, comprising:

an ion dissociation chamber; and a hollow fiber waveguide having a proximal end and a distal end, wherein the proximal end of the hollow fiber waveguide is positioned to receive infrared energy from an infrared energy source and the distal end of the hollow fiber waveguide is disposed within the ion dissociation chamber; and an infrared transparant window coupled to the proximal end of the hollow fiber waveguide, wherein the infrared transparent window assists in maintaining pressures both within the hollow fiber waveguide and the ion dissociation chamber.

2. A system in accordance with claim 1, further comprising an infrared energy source.

3. A system in accordance with claim 1, wherein the hollow fiber waveguide is flexible.

4. A system in accordance with claim 1, wherein the hollow fiber waveguide comprises a hollow fused silica body having an optically reflective inner layer.

5. A system in accordance with claim 1, further comprising an aperture housing having an orifice, wherein the aperture housing is located between an infrared laser energy source and the proximal end of the hollow fiber waveguide.

6. A system in accordance with claim 5, wherein an inner diameter of the orifice is less than or equal to a hollow inner diameter of the hollow fiber waveguide.

7. A system in accordance with claim 5, further comprising a positional alignment system coupled to the aperture housing and the proximal end of the hollow fiber waveguide.

8. A system in accordance with claim 1, further comprising a focusing lens located between an infrared laser energy source and the proximal end of the hollow fiber waveguide.

9. A system in accordance with claim 1, further comprising:

an infrared laser energy source;

a focusing lens located between an infrared laser energy source and the proximal end of the hollow fiber waveguide; and an aperture housing having an orifice, wherein the apeerture housing is coupled to the infrared transparent window.

10. A system in accordance with claim 9, further comprising a positional alignment system to control the location of the proximal end of the hollow fiber waveguide.

11. A system in accordance with claim 1, wherein the ion dissociation chamber has an ion storage area and further wherein the distal end of the hollow fiber waveguide is aligned with at least a portion of the ion storage area.

12. A system in accordance with claim 11, wherein the distal end of the hollow fiber waveguide is aligned substantially orthogonally to a longitudinal axis of the ion storage area of the ion dissociation chamber.

13. A system in accordance with claim 11, wherein the distal end of the hollow fiber waveguide is aligned substantially parallel to a longitudinal axis of the ion storage area of the ion dissociation chamber.

14. A system in accordance with claim 13, wherein the distal end of the hollow fiber waveguide is aligned with the longitudinal axis of the ion storage area of the ion dissociation chamber.

15. A system in accordance with claim 11, wherein the distal end of the hollow fiber waveguide is aligned substantially non-orthogonally to a longitudinal axis of the ion storage area of the ion dissociation chamber.

16. A system in accordance with claim 15, wherein the ion dissociation chamber further includes at least one infrared reflective element.

17. A system in accordance with claim 15, wherein at least a portion of the ion dissociation chamber comprises a cylindrical body having an inner infrared reflective wall.

18. A system in accordance with claim 1, wherein the ion dissociation chamber is at least one of the following: an ion trap, an ion guide and an ion reservoir.

19. A system in accordance with claim 18, wherein the ion trap is at least one of the following: a linear multi-pole ion trap and a cylindrical multi-pole ion trap.

20. A system in accordance with claim 1, wherein the pressure within the ion dissociation chamber is maintained below atmospheric pressure.

21. A method for inducing infrared multiphoton dissociation (IRMPD) of an ion, the method comprising:

positioning a portion of a hollow fiber waveguide with an ion dissociation chamber so that a distal end of the hollow fiber waveguide is aligned with at least a portion of an ion storage area of the ion dissociation chamber;

positioning an infrared transparent window adjacent to a proximal end of the hollow infrared waveguide, wherein the infrared transparent windiw assists in maintaining pressures both within the hollow fiber waveguide and the ion dissociation chamber;

directing an ion into the ion storage area of the ion dissociation chamber;

directing infrared energy into the proximal end of the hollow fiber waveguide;

delivering via the distal end of the hollow fiber waveguide at least a portion of the infrared energy to the ion located within the ion storage area of the ion dissociation chamber to cause fragmentation of the ion.

22. A method in accordance with claim 21, further comprising generating the infrared energy.

23. A method in accordance with claim 22, wherein the infrared energy is generated by a infrared laser source.

24. A method in accordance with claim 21, wherein the hollow fiber waveguide is flexible.

25. A method in accordance with claim 21, further comprising protecting the proximal end of the hollow fiber waveguide with an aperture housing.

26. A method in accordance with claim 21, wherein directing the infrared energy into the proximal end of the hollow fiber waveguide comprises utilizing a focusing lens.

27. A method in accordance with claim 21, wherein directing the infrared energy into the proximal end of the hollow fiber waveguide comprises utilizing a positional alignment system to position an end of the infrared waveguide.

28. A method in accordance with claim 21, wherein the distal end of the hollow fiber waveguide is aligned substantially orthogonally to a longitudinal axis of the ion storage area of the ion dissociation chamber.

29. A method in accordance with claim 21, wherein the distal end of the hollow fiber waveguide is aligned substantially parallel to a longitudinal axis of the ion storage area of the ion dissociation chamber.

30. A method in accordance with claim 29, wherein the distal end of the hollow fiber waveguide is aligned with the longitudinal axis of the ion storage area of the ion dissociation chamber.

31. A method in accordance with claim 21, wherein the distal end of the hollow fiber waveguide is aligned substantially non-orthogonally to a longitudinal axis of the ion storage area of the ion dissociation chamber.

32. A method in accordance with claim 31, wherein at least a portion of one of the following is delivered to the ion: incident infrared energy and reflected infrared energy.

33. A method in accordance with claim 21, wherein a power density of the portion of the infrared energy that is delivered to the ion is controlled by altering a path characteristic of the infrared waveguide.

34. A method in accordance with claim 21, wherein the pressure within the ion dissociation chamber is maintained below atmospheric pressure.

35. A system for delivering an infrared energy beam to an ion dissociation chamber, the system comprising:

an ion dissociation chamber having an ion storage area;

a hollow fiber waveguide having a first end which is disposed outside of the ion dissociation chamber and a second end which is disposed within the ion dissociation chamber, wherein the first end of the hollow fiber waveguide can receive an infrared energy beam;

an infrared transparent window coupled to the first end of the hollow fiber waveguide; and an aperture housing having an orifice coupled to the infrared transparent window, wherein the second end of the hollow fiber waveguide is aligned with at least a portion of the ion storage area of the ion dissociation chamber.

36. A method for delivering an infrared energy beam to an ion dissociation chamber, the method comprising:

generating an infrared energy beam;

directing the generated infrared energy beam into an end of a flexible hollow fiber waveguide;

positioning an infrared transparent window adjacent to the end of the flexible hollow fiber waveguide, wherein the infrared transparent window assists in maintaining pressures both within the flexible hollow fiber waveguide and the ion dissociation chamber;

aligning the other end of the flexible hollow fiber waveguide with at least a portion of an ion storage area of the ion dissociation chamber so that at least a portion of the ion storage area of the ion dissociation chamber is exposed to at least a portion of the infrared energy beam.

37. A system for delivering an infrared energy beam to an ion dissociation chamber, the system comprising:

an ion dissociation chamber having an ion storage area;

a hollow fiber waveguide having a first end which is disposed outside of the ion dissociation chamber and a second end which is disposed within the ion dissociation chamber, wherein the first end of the hollow fiber waveguide can receive an infrared energy beam;

an aperture housing having an orifice coupled to the first end of the hollow fiber waveguide; and an infrared transparent window coupled to the an aperture housing, wherein the second end of the hollow fiber waveguide is aligned with at least a portion of the ion storage area of the ion dissociation chamber.

* * * * *